US007410117B2

(12) United States Patent
Klein et al.

(10) Patent No.: US 7,410,117 B2
(45) Date of Patent: Aug. 12, 2008

(54) DEVIATION DEVICE FOR A COILER INSTALLATION FOR COILING STRIPS

(75) Inventors: Christoph Klein, Kreuztal-Eichen (DE); Günter Kneppe, Hilchenbach (DE); Karl Hoen, Asbach (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/538,969

(22) PCT Filed: Nov. 25, 2003

(86) PCT No.: PCT/EP03/13216

§ 371 (c)(1),
(2), (4) Date: Jan. 26, 2006

(87) PCT Pub. No.: WO2004/054733

PCT Pub. Date: Jul. 1, 2004

(65) Prior Publication Data

US 2006/0144981 A1 Jul. 6, 2006

(30) Foreign Application Priority Data

Dec. 14, 2002 (DE) ..... 102 58 499

(51) Int. Cl.
*B65H 18/08* (2006.01)

(52) U.S. Cl. ..... 242/534.1; 226/615.1; 226/566

(58) Field of Classification Search ..... 242/531.1, 242/566, 532.2, 615.1, 615.11, 615.4; 72/146, 72/148; 226/181, 188, 189
See application file for complete search history.

(56) References Cited

U.S. PATENT DOCUMENTS 2,268,125 A 12/1941 Nash et al.
4,014,487 A * 3/1977 Reba et al. ..... 226/5
4,669,679 A * 6/1987 Pali ..... 242/362.1
6,082,659 A * 7/2000 Sankaran et al. ..... 242/527.2
6,364,242 B1 * 4/2002 Braun et al. ..... 242/532
6,578,789 B1 * 6/2003 Braun et al. ..... 242/531.1

FOREIGN PATENT DOCUMENTS

| | | |
|---|---|---|
| DE | 44 42 567 | 6/1996 |
| DE | 198 35 110 | 2/2000 |
| DE | 198 56 767 | 5/2000 |

* cited by examiner

*Primary Examiner*—Evan H Langdon
(74) *Attorney, Agent, or Firm*—Friedrich Kueffner

(57) ABSTRACT

The invention relates to a device for deflecting sections of strip, in particular metal strip, in a coiling plant, from a beginning guide channel (1) to an end guide channel (2) and vice-versa, comprising a driver (3) with a pair of driver rollers (4, 4') and control elements arranged downstream in strip conveyance direction, comprising a switch (5) that can be swiveled towards the beginning guide channel (1) or the end guide channel (2), and a guide table (6) which is swivelably supported under the switch (5) and positionable as a wiper against the lower driver roller (4'). The deflection of sections of strip is optimized in that the switch (5) is convexly shaped at its top and bottom sides and is flexibly arranged at the outlet end of an assigned strip transport roller-conveyor (7, 7'), such that it clears the beginning guide channel (1) when in a raised position and rests in the function of a wiper against the upper driver roller (4), and in that the guide table (6) is concavely shaped corresponding to the bottom of the switch (5). An actuating mechanism each, for example, a hydraulic unit (8, 8'), is assigned to both the switch (5) and the guide table (6).

5 Claims, 7 Drawing Sheets

DEVIATION DEVICE FOR A COILER INSTALLATION FOR COILING STRIPS

The invention relates to a device for deflecting sections of strip, in particular metal strip, into a coiling plant, from a beginning guide channel to an end guide channel and vice-versa, comprising a driver with a pair of driver rollers and control elements arranged downstream in strip conveyance direction, comprising a switch that can be swiveled towards the beginning guide channel or the end guide channel, and a guide table which is swivelably supported under the switch and positionable as a wiper against the lower driver roller.

The performance of such a deflection device in a coiling plant depends on the fact that the beginning of the strip, the so-called strip head, of a strip following the strip end of the preceding strip, is fed to a different coil than the preceding strip end. To this effect, two different strip guide channels are provided for sections of strip, namely a so-called "beginning guide channel" and a corresponding "end guide channel". Thus, during a change of strip, each strip has to be deflected from a beginning guide channel to an end guide channel—and vice versa. In practice this is required both for a multiple coiling plant and for a rotary coiler or recoiler plant.

For sections of strip which follow each other at an adequate distance, there is sufficient time to carry out the required deflection without any problem because all of the elements of the respective deflection device can be moved to the next position prior to the entry of the subsequent strip.

However, the smaller the spacing of successive sections of strip become, the faster the strip change has to take place, eventually resulting in time-critical positioning processes which in extreme cases may cause damage and/or switching errors.

It is the object of the present invention to describe a deflection device in a coiling plant which, while avoiding time-critical positioning processes, safely prevents the afore-mentioned difficulties and switching errors and ensures safe functioning during the deflection process even in cases where the sequence intervals of the strip are extremely small.

This object is met in a device for deflecting sections of strip, in particular metal strip, in a coiling plant of the type mentioned in the preamble of claim 1, in that the switch is convexly shaped both at its top and the bottom sides and flexibly arranged at the outlet end of an associated strip transport roller-conveyor, such that the switch in a raised position clears the beginning guide channel, and in that the guide table is concavely shaped corresponding to the bottom of the switch, and in that an actuating mechanism such as, for example, a hydraulic unit each is assigned to the switch and the guide table. This makes it possible, even before the strip end has passed, to position the switch such that the path to the end guide channel or to the beginning guide channel is cleared. This eliminates the danger of tearing the strip, or even breaking pieces thereof off while being guided past the sharp-edged point of the switch.

This embodiment according to the invention succeeds in deflecting strip without problems when there is extremely little spacing between successive sections of strip.

Further embodiments of the device are provided according to the characteristics of the subordinate claims.

The invention is shown in detail by means of the following drawings:

FIGS. 1 to 7 show in detail the deflection device according to the invention, for a rolling strip in a coiling plant. The coiler is not shown herein, however a multiple coiling plant or a rotary coiler or recoiler plant may be used.

Figure 1:
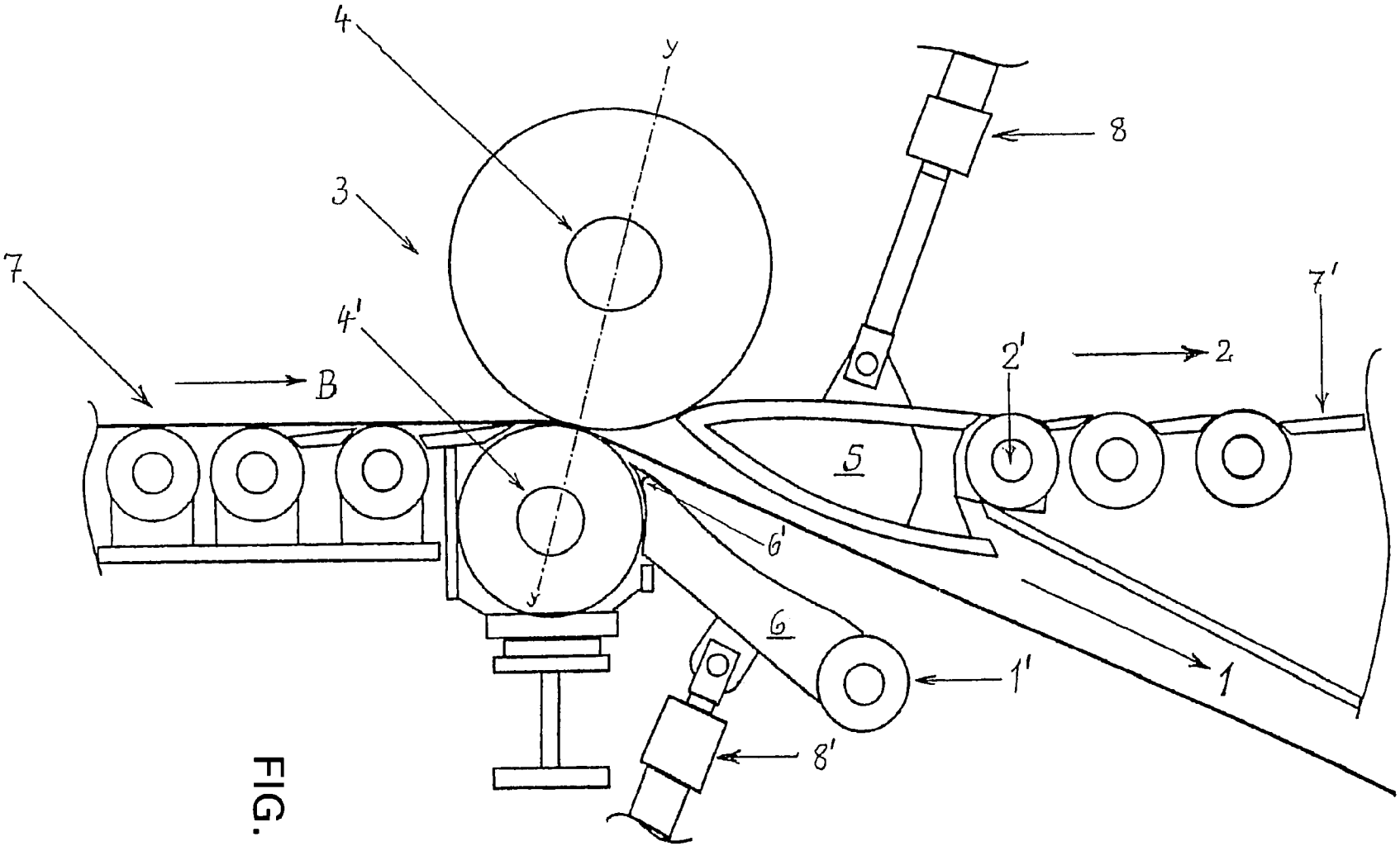
FIG. 1 shows the deflection device with beginning guide channel and end guide channel between parts of a roller conveyor and comprising a driver in an inclined plane y-y with the switch abutting the upper driver roller.

The beginning guide channel 1 and the end guide channel 2 located above the beginning guide channel 1 are provided for separably guiding the uncoiling strip 9 or 9'. According to FIG. 2 the strip head 11 follows the strip end 10 moving towards the driver 3 on the left-hand section 7 of the roller conveyor at a relatively short distance. For further conveyance, the strip head 11 is taken in and pulled through by the conveying gap between the driver rollers 4, 4'.

The driver rollers are thereby driveably supported either in a vertical plane x-x or in an inclined plane y-y, depending on the situation according to the description below. When the strip 9, 9' passes the outflow side, it is guided either into the beginning guide channel 1 or the end guide channel 2, depending on the position of the switch 5 and of the guide table 6. The positioning thereof preferably takes place by means of hydraulic units 8, 8'. The letter B designates the strip conveyance direction through the deflection device according to the invention.

The switch is convexly shaped at its top and bottom sides and thus able to fit snugly against the upper driver roller 4 acting as a wiper when raised. Accordingly, the top of the guide table 6 is concavely shaped for the purpose of providing a positive fit with the bottom of the switch 5, while the free end of the guide table 6 is also shaped for positive fit with the lower driver roller 4'. In this way the guide table 6 meets the requirement of having an additional function as a wiper against the lower driver roller 4'.

The free end of the switch 5 has the shape of two convex sides meeting at a point. This makes it possible for the point to snugly fit against the concave back of the guide table 6 with virtually no gaps, as shown for example in FIGS. 2 to 4.

Figure 7:
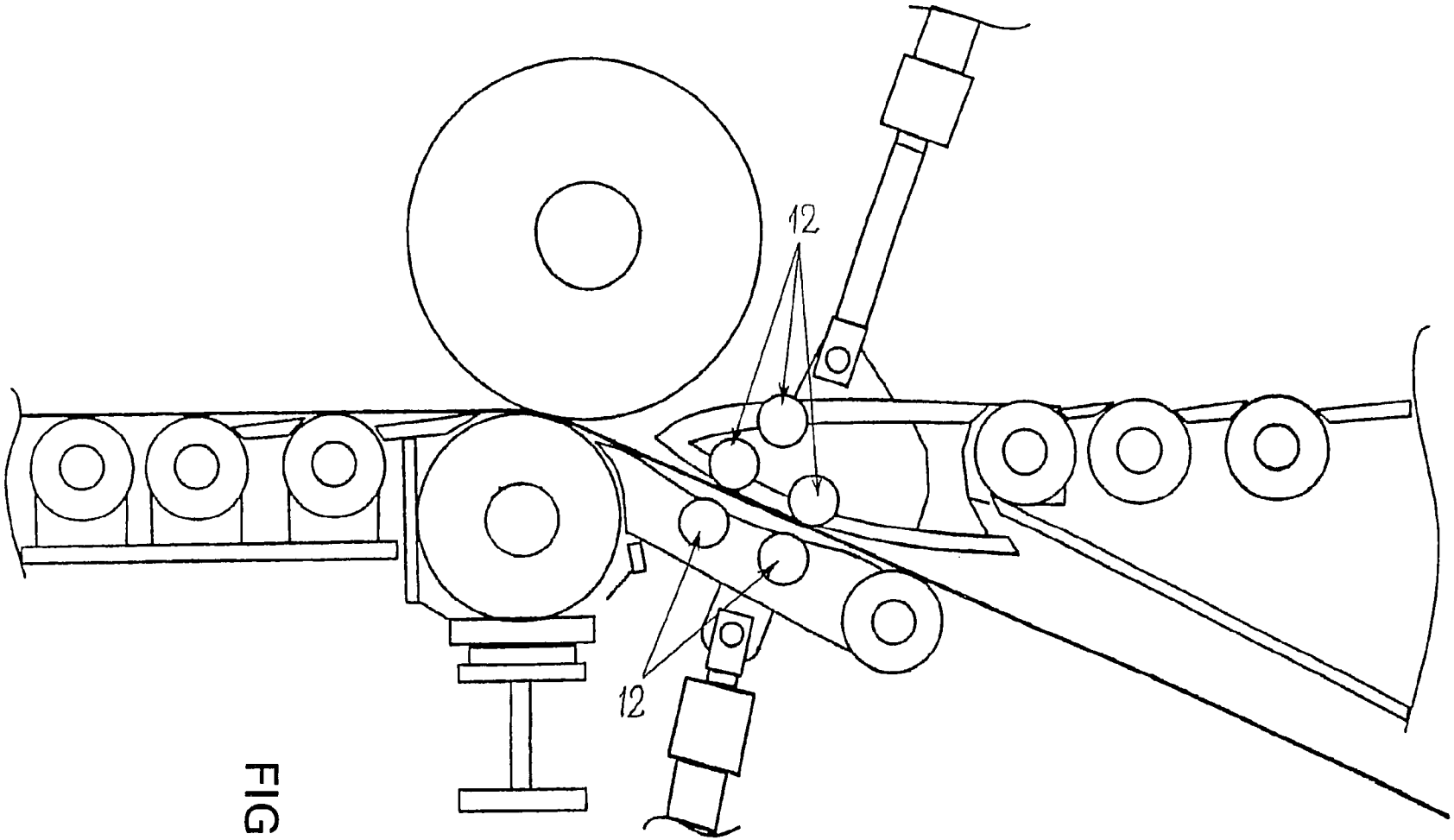
FIG. 7 shows the guide surfaces of the switch and the guide table, which are equipped with small glide rollers.

By assigning the section 7' of the strip transport roller-conveyor on the outflow side to the driver roller pair 4, 4' downstream in strip conveyance direction B, a smooth passage is facilitated for the strip head 11 traversing the switch 5 in its raised position. Finally, according to the embodiment shown in FIG. 7, the guide surfaces of both the switch 5 and the guide table 6 can be equipped with relatively small glide rollers 12, which lead to a reduction of friction and resulting wear in the guide channels 1 and 2.

The deflection of strip from a beginning guide channel or beginning conveyance path to an end guide channel or end conveyance path and vice versa takes place as follows:

1. The strip is deflected from the beginning guide channel 1 into the end guide channel 2;

When strip follow each other in short intervals, the switch 5 is kept in the upper position while the guide table 6 is kept in the lower position in the case of strip passing through the beginning guide channel 1 (FIG. 1).

Shortly before the strip end passes, the guide table 6 is moved to an upper position. When the maximum coil diameter is reached, the strip 9 then either rests on the roller 1' at the end of the guide table 6 or is slightly bent around the roller 1'.

Figure 2:
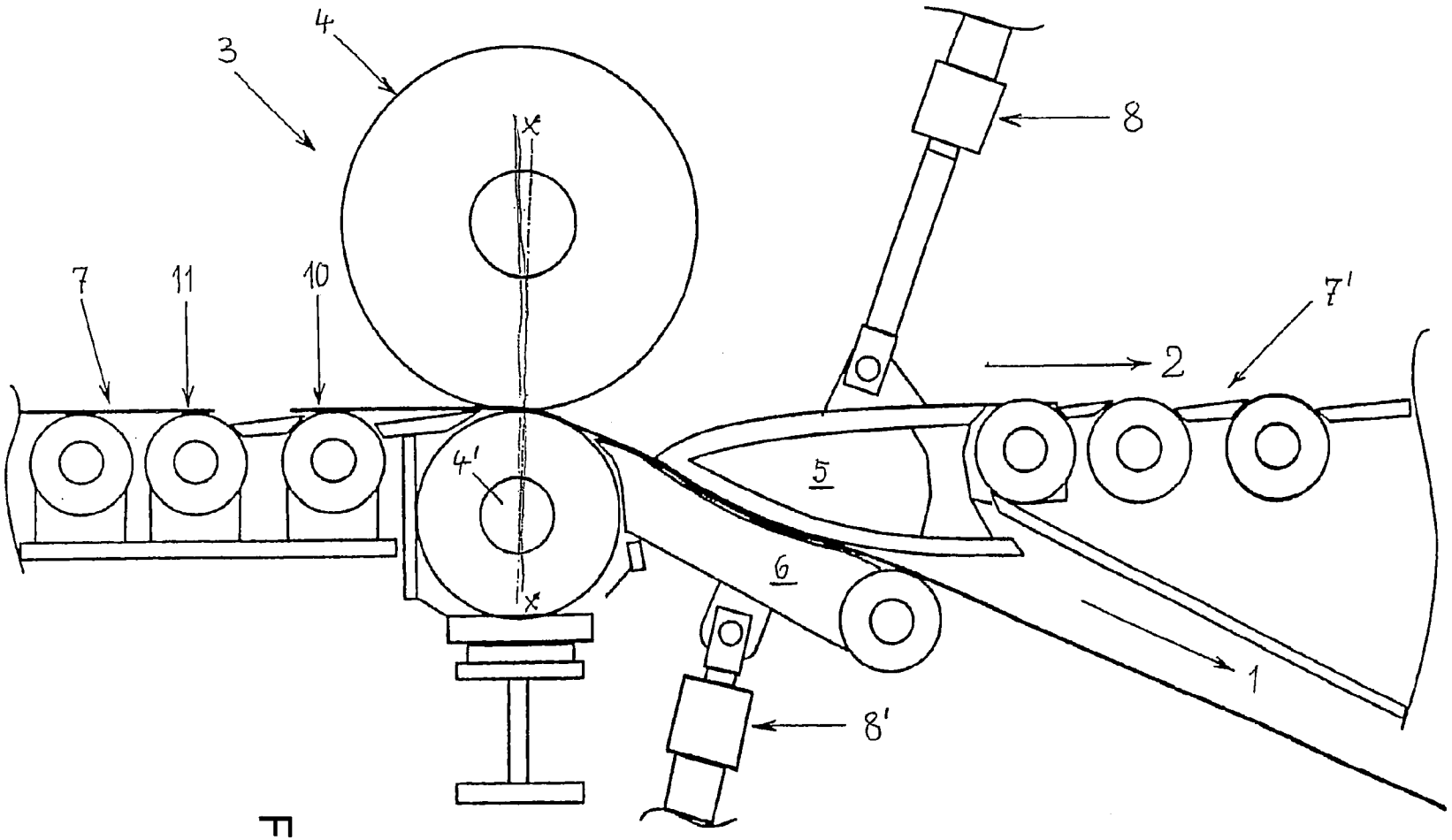
FIG. 2 shows the deflection device with the switch lowered and abutting the guide table at a driver position the vertical plane x-x and with a strip conveyance through the beginning guide channel between the guide table and the switch.

Prior to the passage of the strip end 10, the switch is shifted downwards, thus pressing the strip 9 against the guide table 6, and in so doing clearing the way into the end guide channel 2 (FIG. 2).

Figure 3:
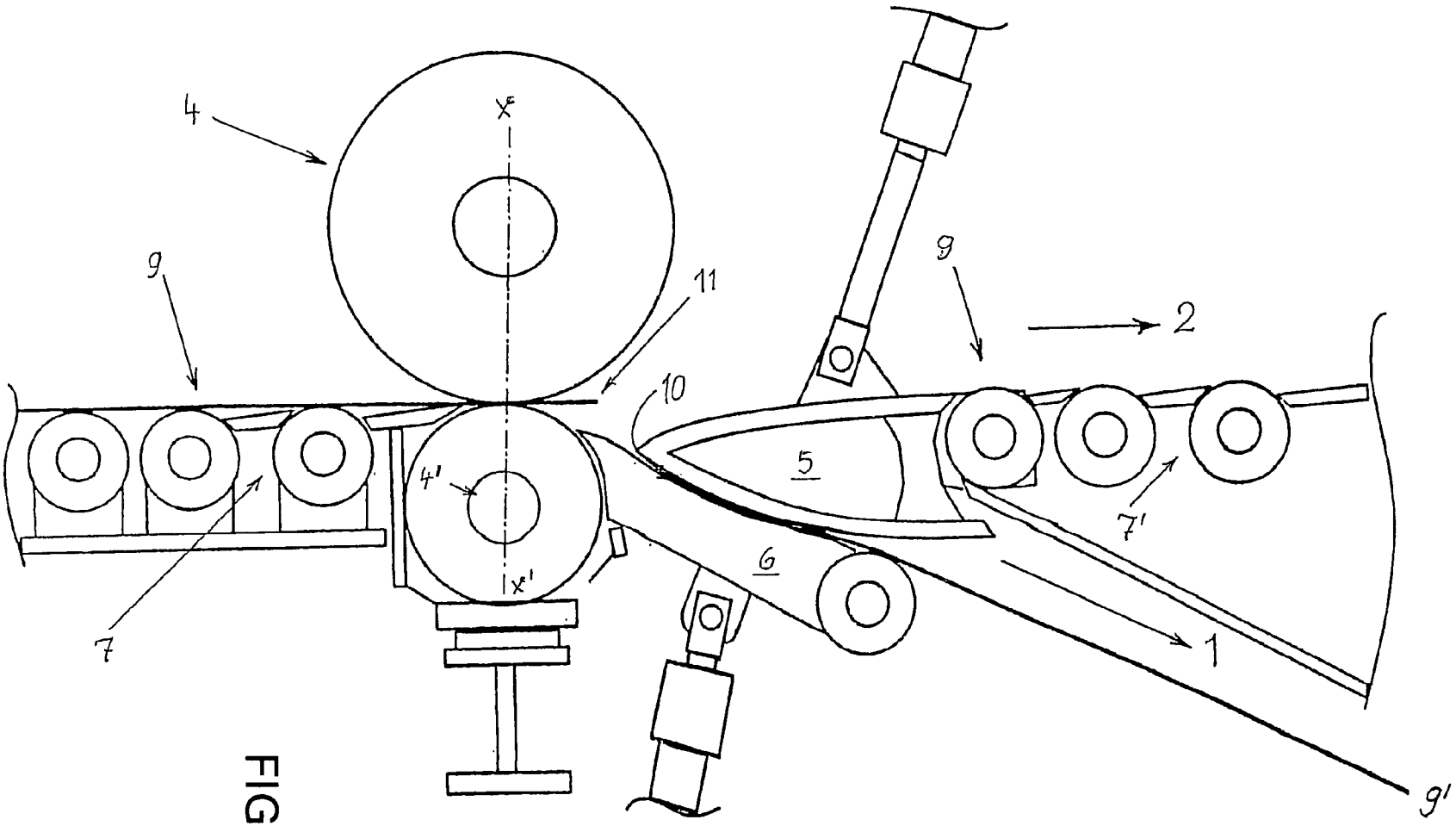
FIG. 3 shows an incoming strip head which is guided into the end guide channel over the lowered switch.
Figure 4:
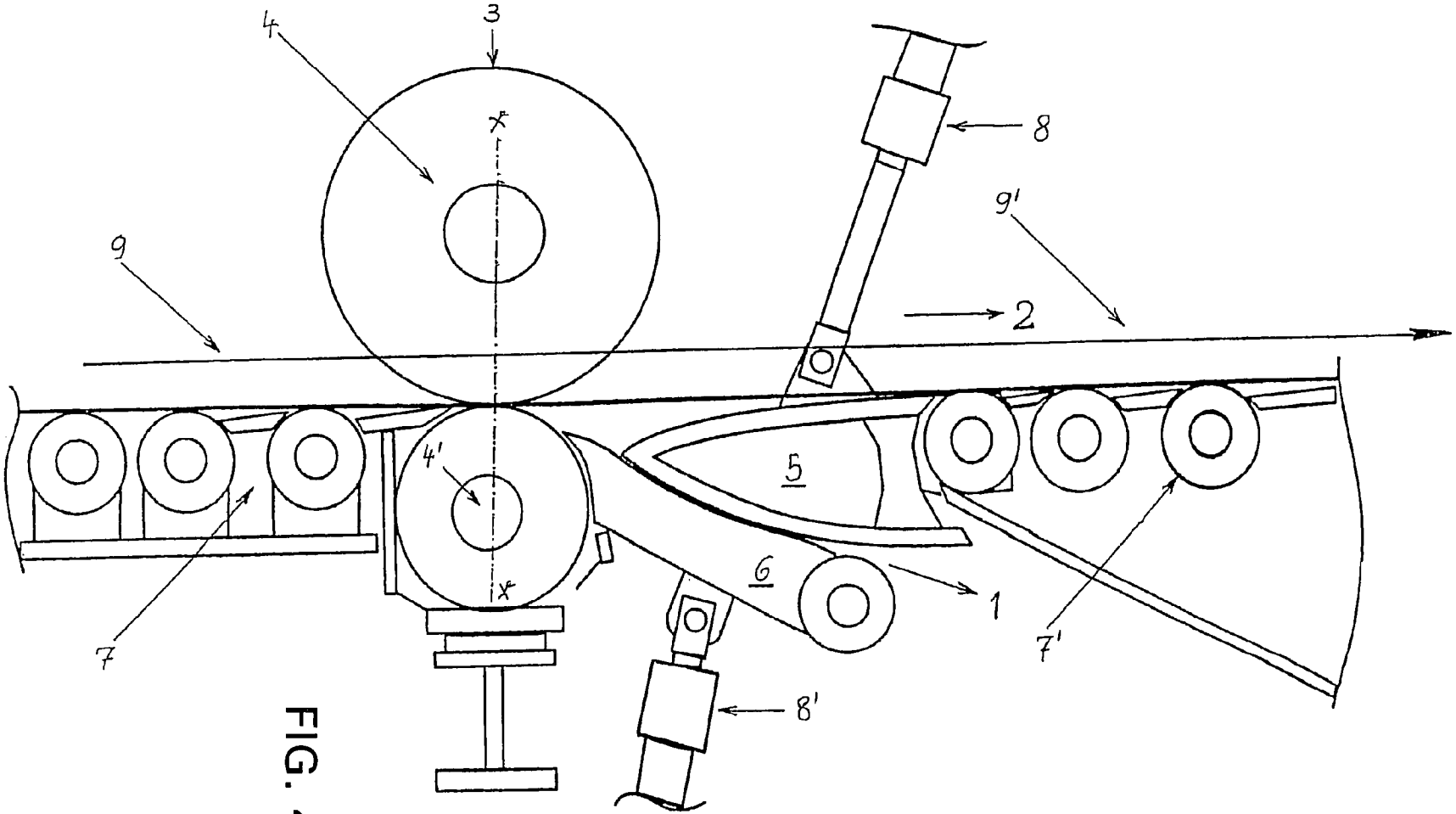
FIG. 4 shows the strip being conveyed through the end guide channel with the driver position and switch position unchanged.

The upper driver roller 4 is placed vertically above the lower roller 4'. In this way the strip head 11 of the subsequent strip 9' can enter the end guide channel 2 while the strip end 10 of the preceding strip 9 is pulled through the guide gap between the switch 5 and the top of the guide table 6 (FIGS. 3 and 4).

2. The strip is deflected from the end guide channel 2 into the beginning guide channel 1; For this purpose, the upper driver roller 4 is pushed into the y-y plane, so that the strip 9 is directed in the direction of the beginning guide channel 1.

Figure 5:
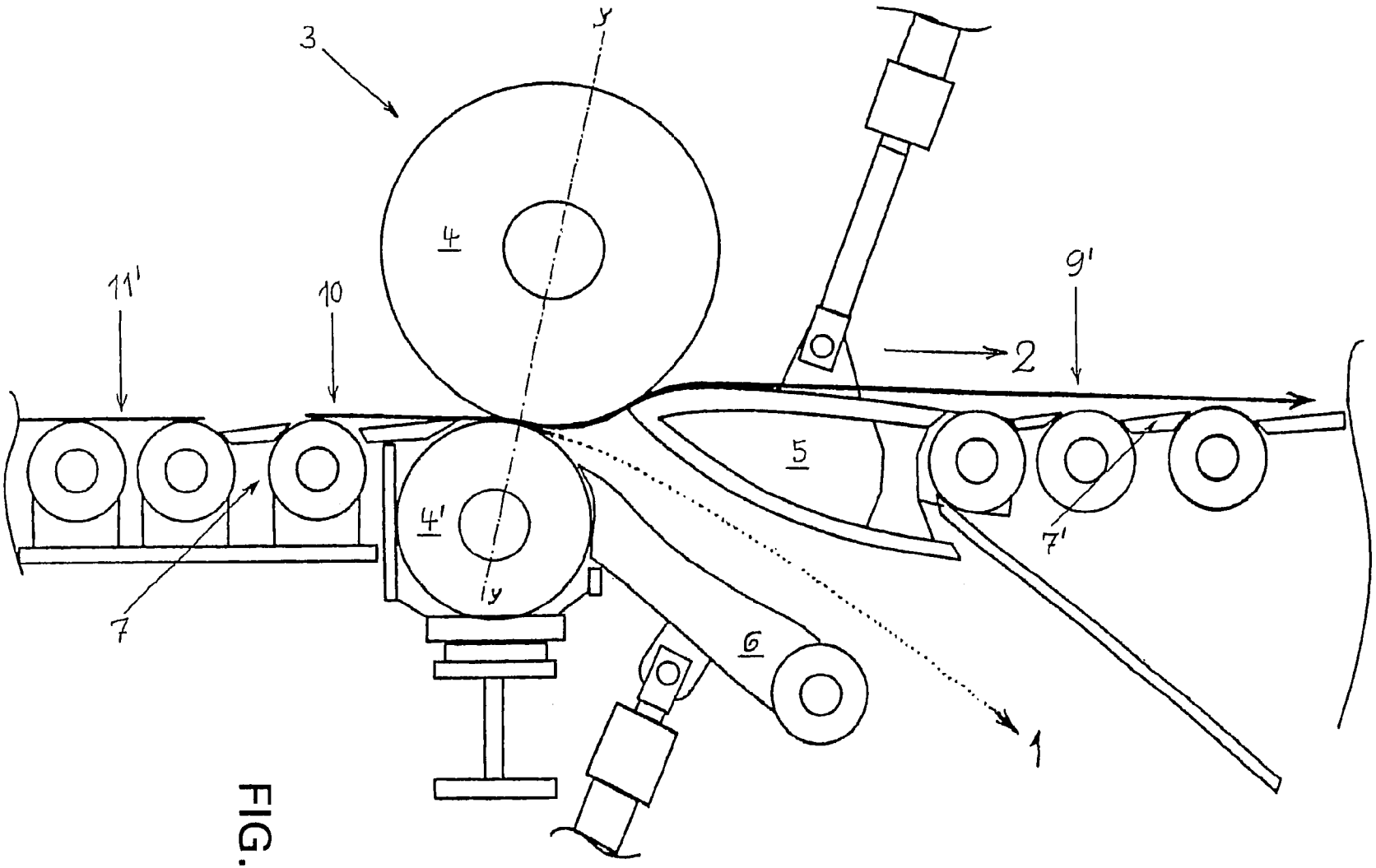
FIG. 5 shows the switch in the upper position and the driver in the inclined plane y-y; the outgoing strip end is positioned with the switch against the upper driver roller, thus preparing the way for the following strip head into the end guide channel.
Figure 6:
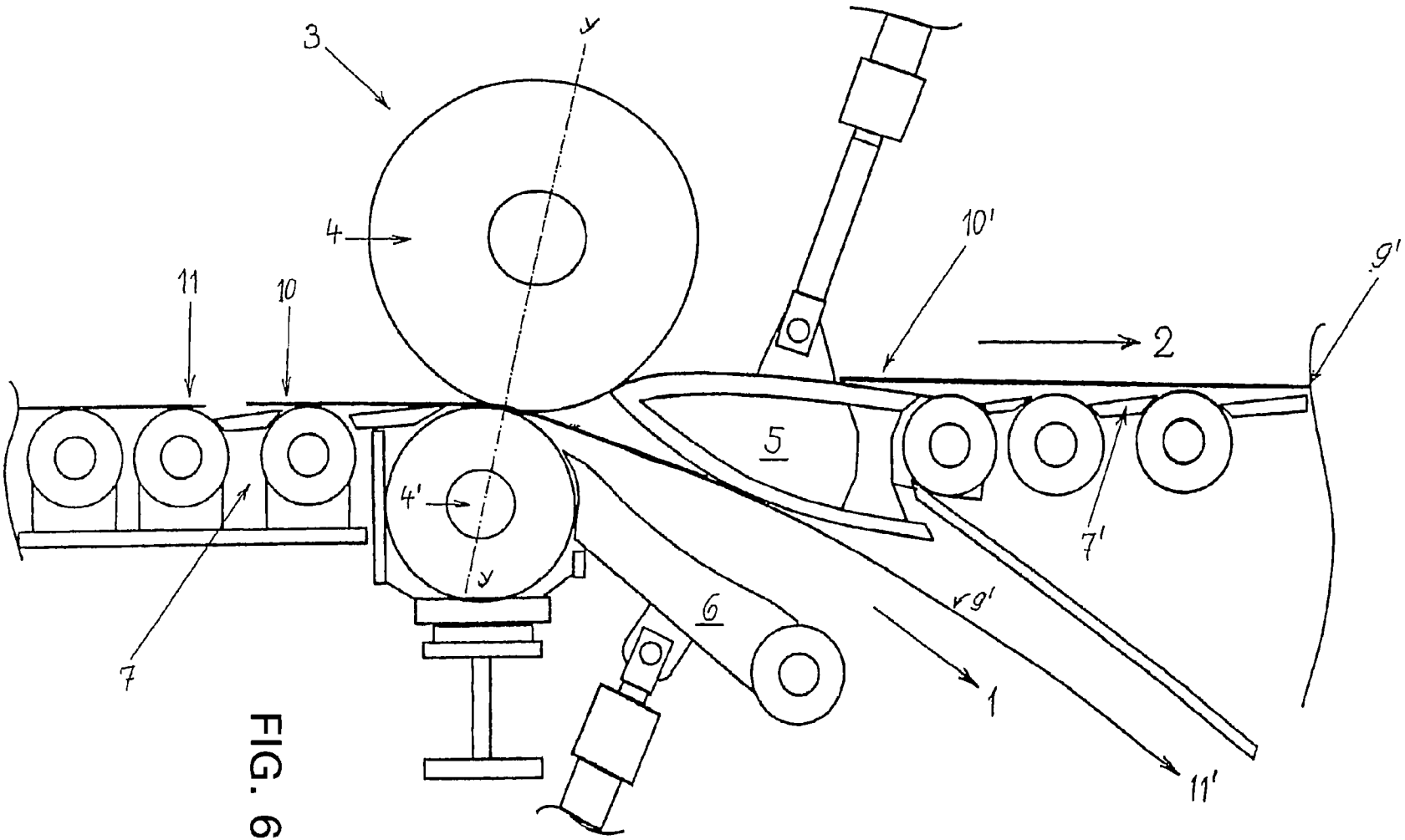
FIG. 6 shows the strip head of the following strip which is guided into the beginning guide channel.

The switch 5 is pushed from underneath against the strip 9' and the upper driver roller 4, thereby clearing the way into the beginning guide channel 1 for the subsequent strip head 11'. The guide table 6 is in its lower position (FIG. 5).

The strip end 10 entering the end guide channel 2 is pulled through between the upper driver roller 4 and the end edge of the switch 5, while the strip head 11 of the subsequent strip is directed into the beginning guide channel.

The measures explained above eliminate the danger of the strip ripping, or of pieces thereof being torn off as a result of the strip being guided past the sharp-edged point of the switch 6.

LIST OF REFERENCE CHARACTERS

1. Beginning guide channel
2. End guide channel
3. Driver
4. Driver rollers 4, 4'
5. Switch
6. Guide table
7. Strip transport roller
8. Hydraulic unit 8, 8'
9. Strip/following strip 9'
10. Strip end 10, 10'
11. Strip head
12. Glide rollers B. Strip conveyance direction

The invention claimed is:

1. A device for deflecting sections of metal strip in a coiling plant, from a beginning guide channel into an end guide channel and from an end guide channel into a beginning guide channel, comprising a driver with a pair of driver rollers and control elements arranged downstream in strip conveyance direction, further comprising a switch that can be swiveled towards the beginning guide channel or the end guide channel, and a guide table which is swivelably supported under the switch and positionable as a wiper against the lower driver roller, wherein the switch is convexly shaped on its top and bottom sides and is flexibly arranged at the outlet end of an assigned strip transport roller-conveyor (7, 7'), such that it clears the beginning guide channel when in a raised position, and in that the guide table is concavely shaped corresponding to the bottom side of the switch, and in that an actuating mechanism each is assigned to both the switch and the guide table, wherein an acute angle end of the switch points against the conveyance direction and a distance between the convex sides of the switch only increases in the conveyance direction.

2. The deflection device according to claim 1 wherein the switch in its function as a wiper rests against the upper driver roller, and the free end of the guide table is shaped so as to provide a positive fit with the lower driver roller, thus assuming the function of a wiper.

3. The deflection device according to claim 1, wherein the free end of the switch has the shape of two convex sides meeting at a point.

4. The deflection device according to claim 1, wherein the outflow end of the strip transport roller-conveyor is assigned to the driver roller pair (4, 4') downstream in strip conveyance direction.

5. The deflection device according to claim 1, wherein the guide surfaces of the switch and of the guide table can be equipped with glide rollers.

* * * * *